US007339543B2

(12) United States Patent
Wang et al.

(10) Patent No.: US 7,339,543 B2
(45) Date of Patent: Mar. 4, 2008

(54) ARRAY ANTENNA WITH LOW PROFILE

(75) Inventors: Shu-Yean Wang, Tu-Cheng (TW); Shang-Jen Chen, Tu-Cheng (TW); Wen-Fong Su, Tu-Cheng (TW); Yun-Long Ke, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 183 days.

(21) Appl. No.: 11/213,506

(22) Filed: Aug. 26, 2005

(65) Prior Publication Data

US 2006/0232488 A1 Oct. 19, 2006

(30) Foreign Application Priority Data

Apr. 19, 2005 (CN) ..... 2005 2 0070984 U

(51) Int. Cl.
*H01Q 9/28* (2006.01)

(52) U.S. Cl. ..... 343/795; 343/700 MS

(58) Field of Classification Search ..... 343/700 MS, 343/795, 846

See application file for complete search history.

(56) References Cited

U.S. PATENT DOCUMENTS 5,293,175 A * 3/1994 Hemmie et al. ..... 343/795
5,708,446 A * 1/1998 Laramie ..... 343/815
5,909,195 A 6/1999 Merenda
6,014,112 A 1/2000 Koscica et al.
6,037,911 A * 3/2000 Brankovic et al. ..... 343/795
6,424,311 B1 * 7/2002 Tsai et al. ..... 343/795
6,859,176 B2 * 2/2005 Choi ..... 343/700 MS
7,183,993 B2 * 2/2007 Dai et al. ..... 343/795
2004/0021613 A1 * 2/2004 Nesic et al. ..... 343/795
2005/0219140 A1 * 10/2005 Browne et al. ..... 343/814

* cited by examiner

*Primary Examiner*—Tan Ho
(74) *Attorney, Agent, or Firm*—Wei Te Chung

(57) ABSTRACT

An array antenna includes a dielectric substrate (10) having an upper and a lower surfaces (101, 102), a first and a second radiating elements (11, 21), a first connecting portion (31) connecting the two radiating elements arranged on the upper surface of the dielectric substrate, a first and a second grounding elements (12, 22), and a second connecting portion (32) connecting the two grounding elements arranged on the lower surface of the dielectric substrate. A feeding point (4) is disposed on the first connecting portion and a grounding point (6) is disposed on the second connecting point. A coaxial cable (7) has an inner conductor (71) coupled to the feeding point and an outer conductor (72) coupled to the grounding point.

20 Claims, 7 Drawing Sheets

ARRAY ANTENNA WITH LOW PROFILE

BACKGROUND OF THE INVENTION

1. Field of the Invention

The present invention relates generally to an antenna, and more particularly to an array antenna for a wireless communication device.

2. Description of Prior Art

Antenna gain is a measure of the ability of the antenna to receive and transmit wireless signals towards a particular direction. Generally speaking, the gain of the antenna mainly depends upon the size of the antenna, the radio frequency at which it operates and the efficiency with which it focuses the radio waves. A helical antenna may have high gain in the present market, but manufacture of this kind of antenna is complex, this antenna needs more accessories and the precision requirement to the dimension is strict so that the quality of the antenna may be difficult of assurance.

In order to increase the antenna gain, lots of antenna units may be arranged at regular intervals to form a radiation system, namely an array antenna. Owing to omni-direction of antenna used in Wireless Local Area Network (WLAN), the researcher needs to concern what kind of antenna unit will be chosen and how to arrange the antenna units. Those skilled in the art may all know that dipole antenna is omnidirectional, thus a dipole antenna will be chosen as an antenna unit in omnidirectional radiation system.

U.S. Pat. No. 6,014,112 issued on Jan. 11, 2000 and entitled "SIMPLIFIED STACKED DIPOLE ANTENNA" discloses an array antenna formed by four dipole antennas. The antenna array is a 75Ω system and operates at 750 MHz. A feed line of the antenna array is formed by metal patterns having a plurality of pairs of adjoining quarter wave resonant sections formed by different widths of the patterns and dipoles respectively coupled to the junctions of the pairs of quarter wave sections. The performance of the antenna array depends mostly on the size of the feed line of the metal pattern. However, the construct of metal pattern is so complicated that manufacture of the antenna array is inconvenient.

SUMMARY OF THE INVENTION

An object of the present invention is to provide an array antenna, which has a low profile configuration and can be manufactured easily.

To achieve the aforementioned object, an array antenna in accordance with the present invention comprises a dielectric substrate having an upper and a lower surfaces, a first and a second radiating elements, a first connecting portion connecting the first and the second radiating elements arranged on the upper surface of the dielectric substrate, a first and a second grounding elements, and a second connecting portion connecting the first and the second grounding elements arranged on the lower surface of the dielectric substrate. A first dipole antenna is formed by the first radiating element and the first grounding element. A second dipole antenna is formed by the second radiating element and the second grounding element. A feeding point is disposed on the first connecting portion and a grounding point is disposed on the second connecting point. A coaxial cable has an inner conductor coupled to the feeding point and an outer conductor coupled to the grounding point.

Additional novel features and advantages of the present invention will become apparent by reference to the following detailed description when taken in conjunction with the accompanying drawings.

DETAILED DESCRIPTION OF THE INVENTION

Reference will now be made in detail to the preferred embodiment of the present invention.

Figure 1:
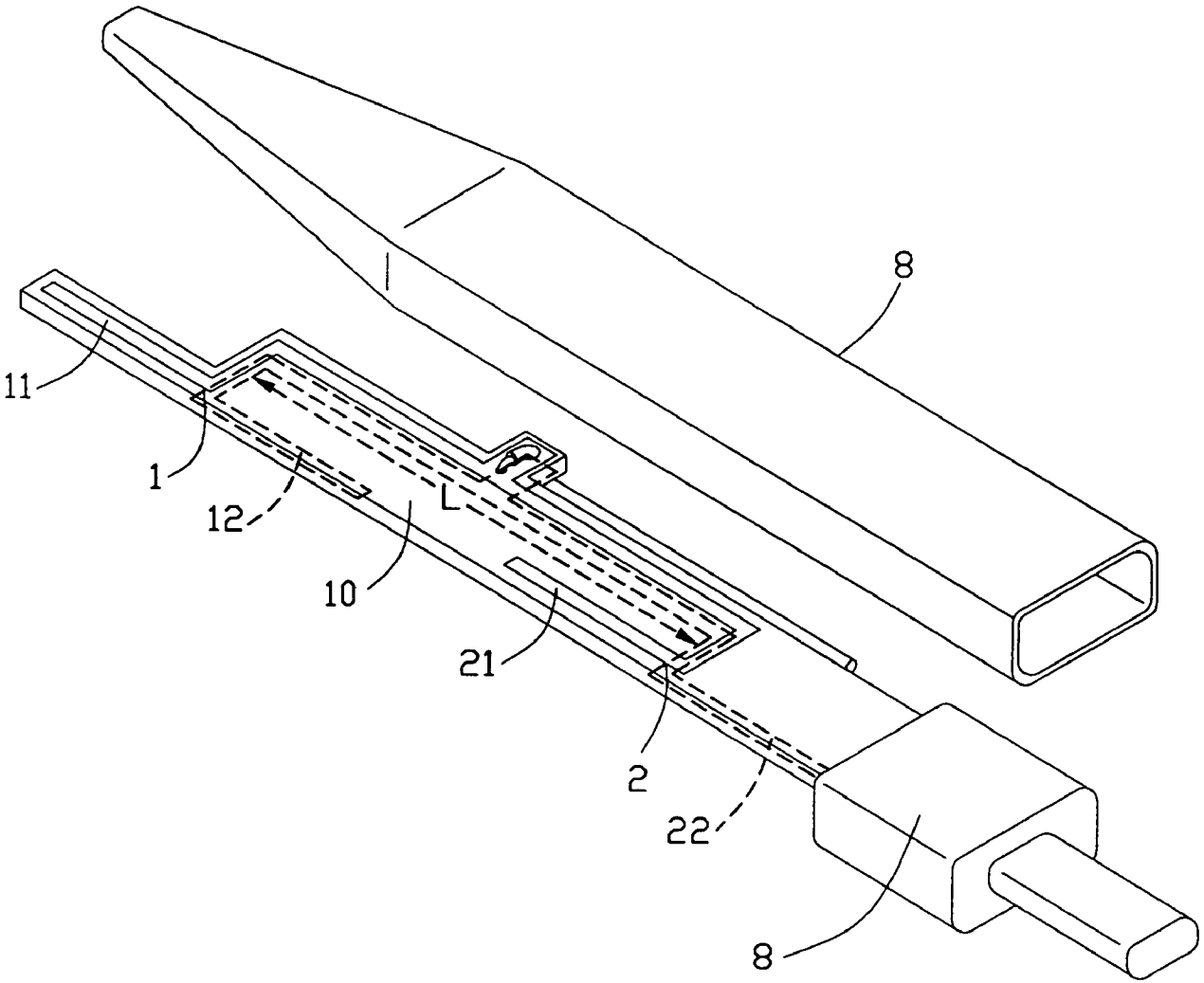
FIG. 1 is a perspective view of an array antenna and an insulative coat in accordance with a preferred embodiment of the present invention.

Referring to FIG. 1, an array antenna in accordance with a preferred embodiment of the present invention is fabricated on a dielectric substrate 10, such as a printed circuit board, and comprises a first dipole antenna 1 and a second dipole antenna 2, which operate at an equal frequency. The first dipole antenna 1 comprises a first radiating element 11 and a first grounding element 12. The second dipole antenna 2 comprises a second radiating element 21 and a second grounding element 22. The first dipole antenna 1 and the second dipole antenna 2 are arranged in a line on the dielectric substrate 10 and the distance L between the two dipole antennas 1, 2 is a half to three quarters of a wavelength attained at the operating frequency of the dipole antennas. Additionally, there positioned an insulative coat 8 covering the array antenna for protecting the array antenna.

Figure 2:
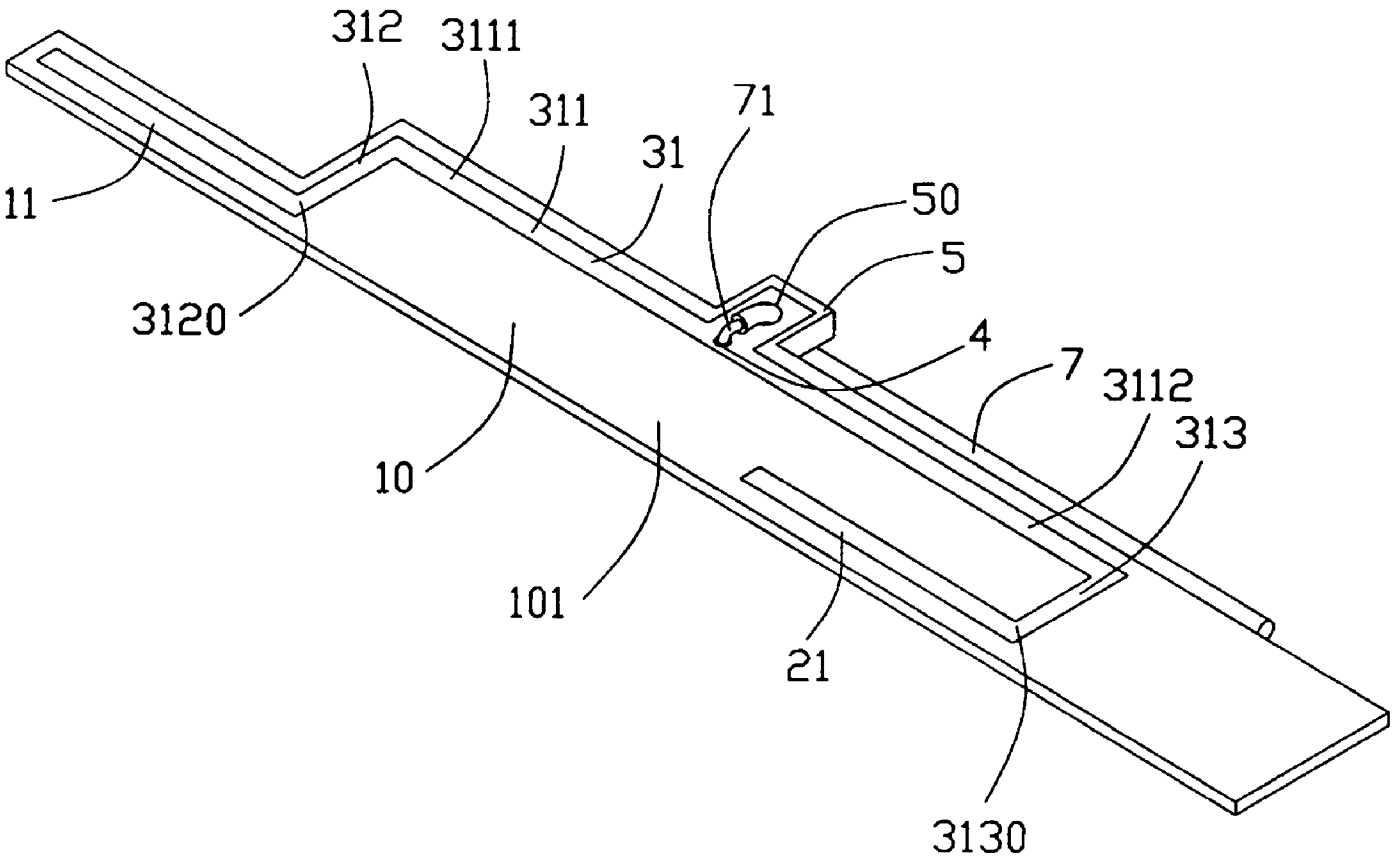
FIG. 2 is a top view of the array antenna of FIG. 1.
Figure 3:
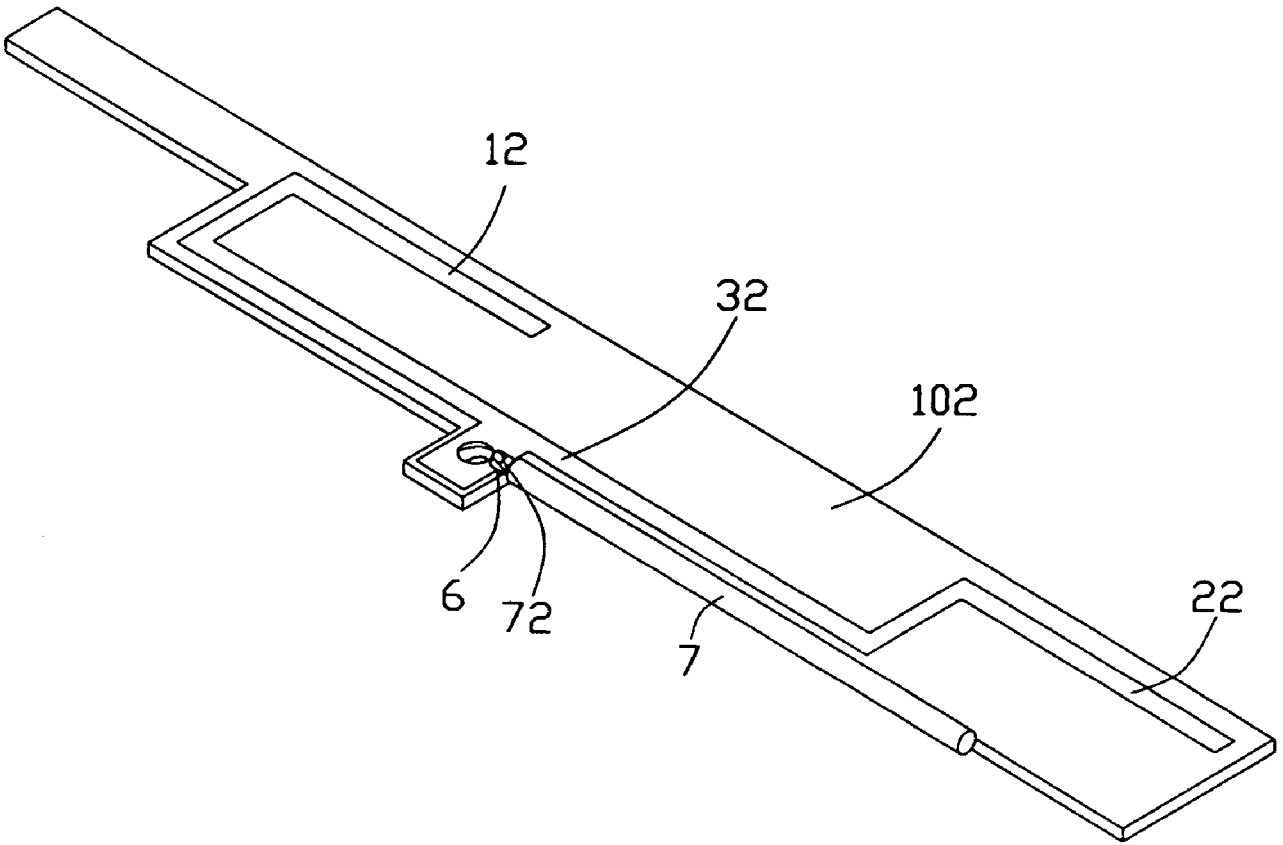
FIG. 3 is a bottom view of the array antenna of FIG. 1.

As can be seen from FIGS. 2-3, the dielectric substrate 10 includes an upper surface 101 and a lower surface 102 opposite to the upper surface 101. The first radiating element 11, the second radiating element 21 and a first connecting portion 31 coupling the first and second radiating elements 11, 21 are disposed on the upper surface 101 of the dielectric substrate 10 and are made from metal material. A feeding point 4 is set at a central position of the first connecting portion 31, and an insulative tab 5 is disposed adjacent to the feeding point 4 and defines a hole 50 therein for allowing a feeding line 7 to extend therethrough. The first connecting portion 31 includes a horizontal part 311, and first and second vertical parts 312, 313 perpendicular to the horizontal part 311. An end tip 3120 of the first vertical part 312 and an end tip 3130 of the second vertical part 313 connect to the first radiating element 11 and a second radiating element 21, respectively. A metal trace from the feeding point 4 to a free distal end of the first radiating element 11 is formed in a reversed Z-shape by a first section 3111 of the horizontal part 311, the first vertical part 312 extending perpendicularly from a distal end of the first section 3111 and the first radiating element 11 extending perpendicularly and outside from a distal end of the first vertical part 312. A metal trace from the feeding point 4 to a free distal end of the second radiating element 21 is formed in a reversed η-shape by a second section 3112 of the horizontal part 311, the second vertical part 313 extending perpendicularly from a distal end of the second section 3112 and the second radiating element 21 extending perpendicularly and inside from a distal end of the second vertical part 313. Both of the lengths of the first and second radiating elements are a quarter of a wavelength attained at the operating frequency.

The first grounding element 12, the second grounding element 22 and a second connecting portion 32 coupling the first and second grounding element 12, 22 are disposed on the lower surface 102 of the dielectric substrate 10. A grounding point 6 is set at a central position of the second connecting portion 32. A metal trace on the lower surface 102 of the dielectric substrate 10 formed by the first grounding element 12, the second grounding element 22 and the second connecting portion 32 has the same configuration as the metal trace on the upper surface 101 of the dielectric substrate 10. A metal trace from the grounding point 6 to a free distal end of the first grounding element 12 is formed in a reversed η-shape and a metal trace from the grounding point 6 to the second grounding element 22 is formed in a reversed Z-shape. The second connecting portion 32 is overlapped with and spaced from the first connecting portion 31 with the dielectric substrate 10 being sandwiched therebetween. The lengths of the first and second grounding elements 12, 22 are respectively equal to the lengths of the first and second radiating element 11, 21.

The feeding line 7 in accordance with the preferred embodiment is a coaxial cable 7, which includes an inner conductor 71 and an outer conductor 72. The inner conductor 71 is welded to the feeding point 4 through the hole 50 and the outer conductor 72 is welded to the grounding point 6. When the power is provided to the array antenna, the first and second dipole antennas will exhibit the same amplitude and phase excitation.

Figure 4:
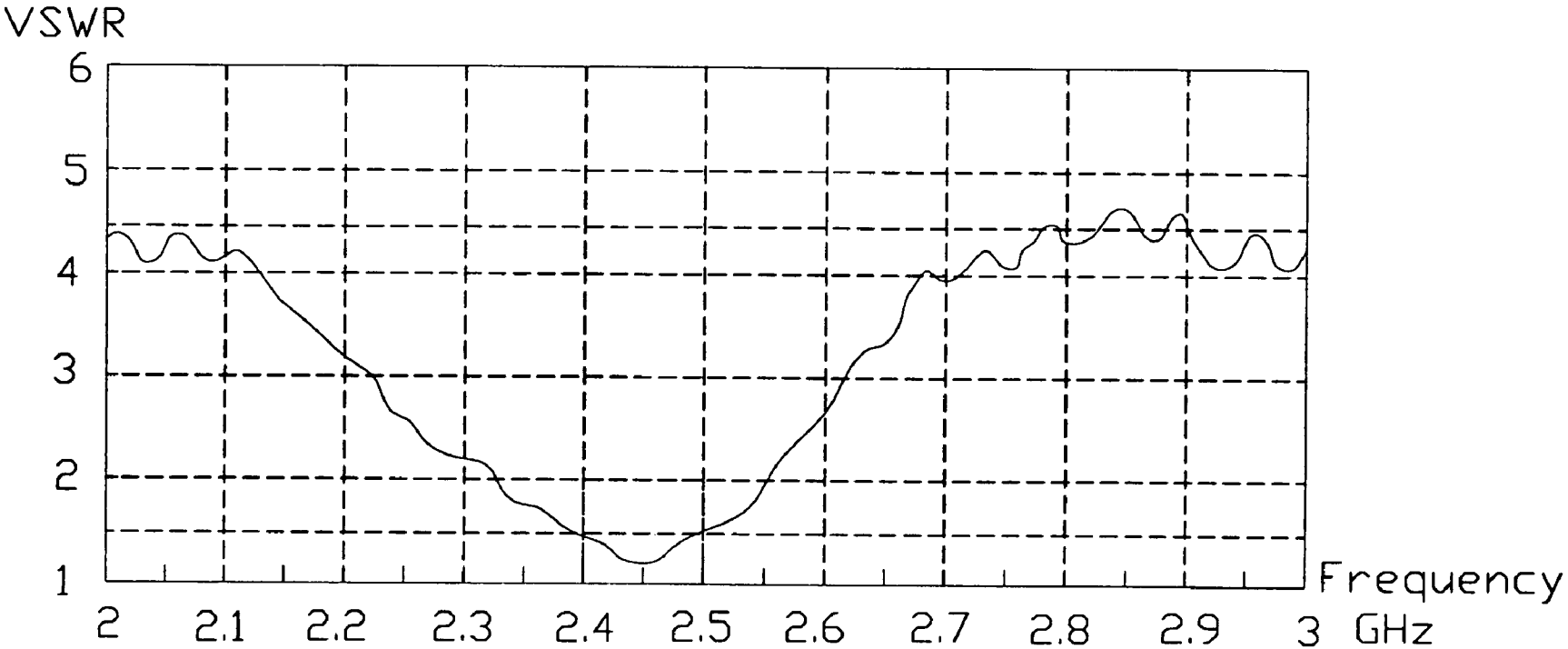
FIG. 4 is a test chart recording for the array antenna of FIG. 1, showing Voltage Standing Wave Ratio (VSWR) as a function of frequency.

FIG. 4 illustrates a test chart of Voltage Standing Wave Ratio (VSWR) of the array antenna in FIG. 1. The central frequency of the resonant frequency band is around 2.45 GHz. The VSWR value is an indication of the quality of the antenna, and is preferably less than 2 so as to prevent interference during transmission or reception of signals. Seen from FIG. 4, under the definition of the VSWR less than 2, the bandwidth of the resonant frequency covers 2.34 GHz-2.54 GHz. The frequency band is wide and covers the band for Wireless Local Area Network (WLAN) under IEEE 802.11b.

Figure 5:
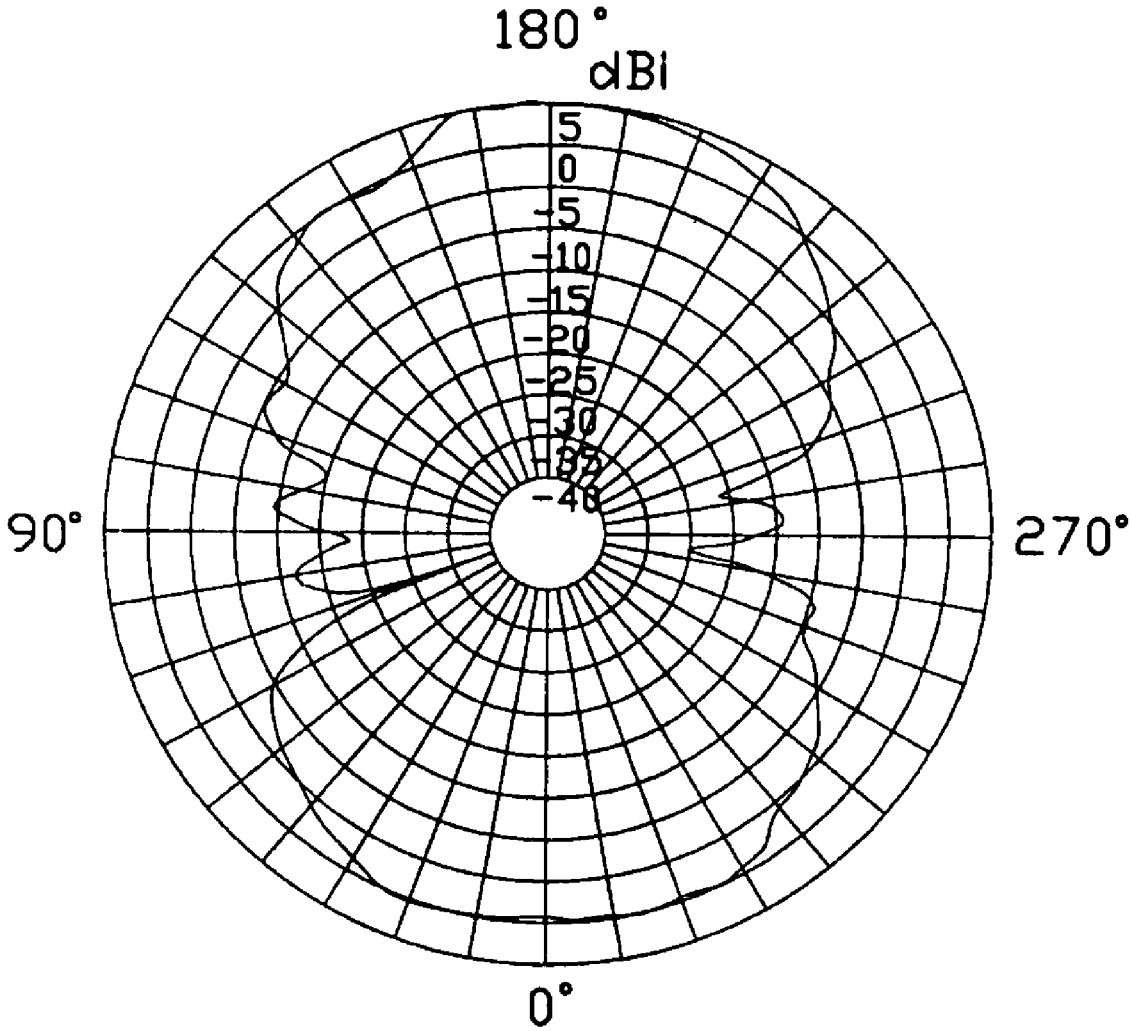
FIG. 5 is an E-plane radiation pattern of the array antenna of FIG. 1 operating at a frequency of 2.45 GHz.
Figure 6:
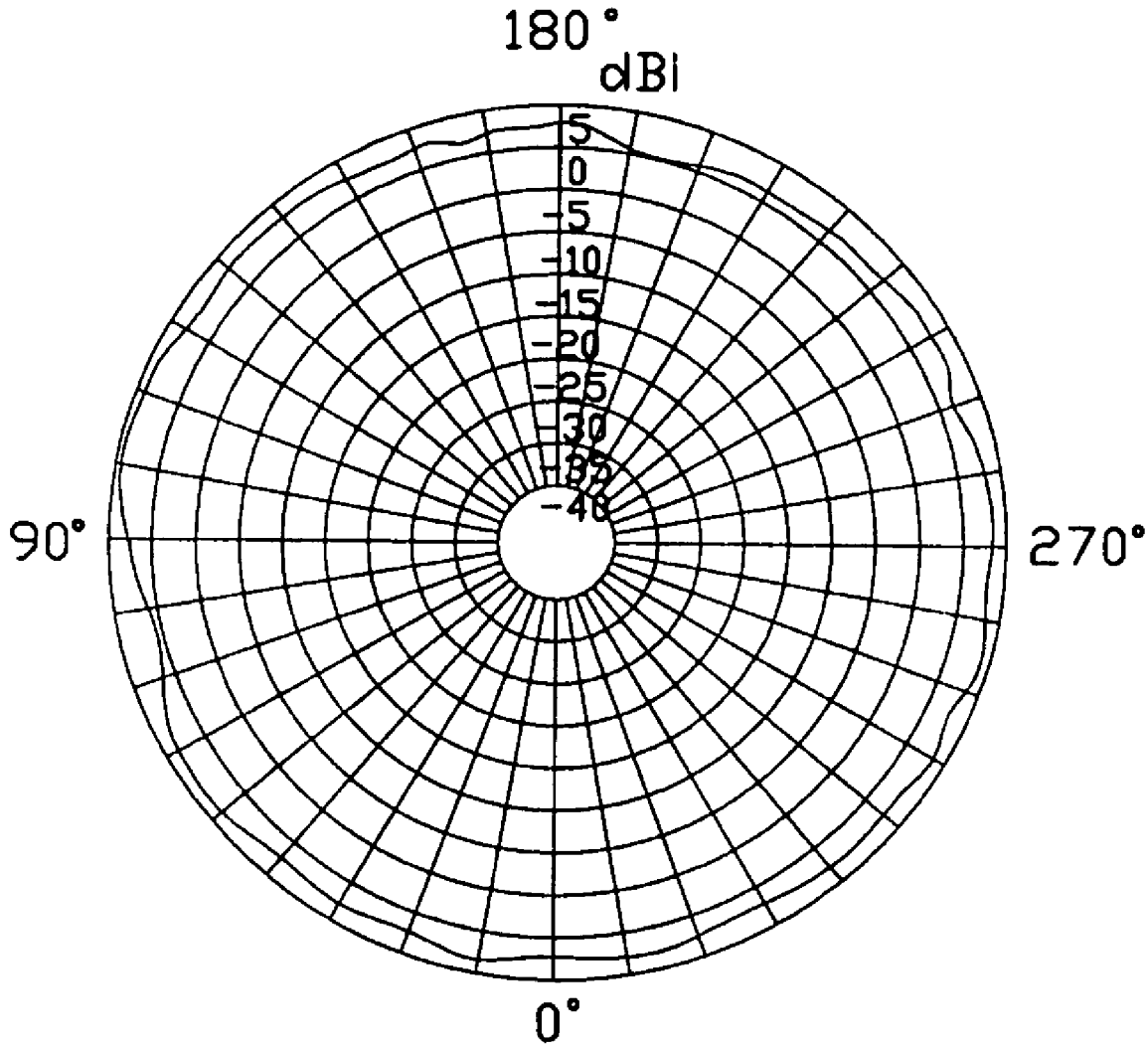
FIG. 6 is a H-plane radiation pattern of the array antenna of FIG. 1 operating at a frequency of 2.45 GHz.

FIGS. 5-6 respectively show E-plane and H-plane radiation patterns of the antenna operating at the frequency of 2.45 GHz. Note that the array antenna may satisfy the directivity and gain required by the WLAN.

Figure 7:
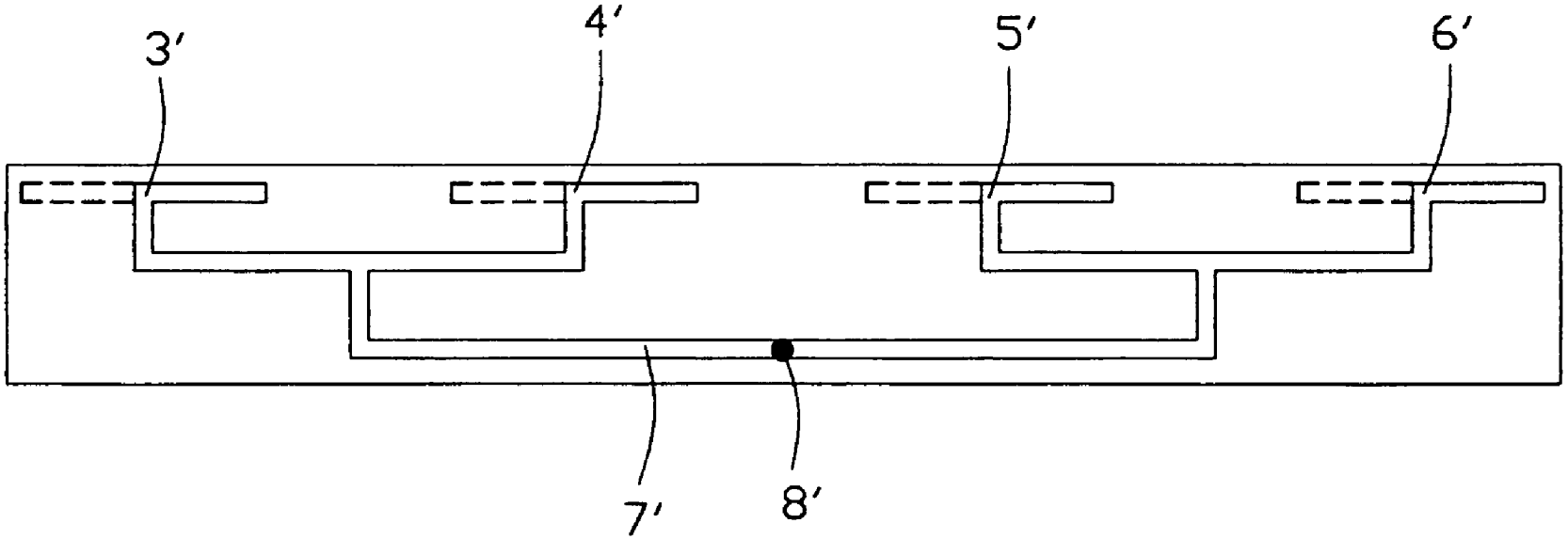
FIG. 7 is a planar view of an array antenna in accordance with another preferred embodiment of the present invention.

FIG. 7 shows an array antenna in accordance with another embodiment of the present invention, which comprises four dipole antennas, that is, the third dipole antenna 3', the fourth dipole antenna 4', the fifth dipole antenna 5' and the sixth dipole antenna 6'. As a matter of fact, the array antenna of FIG. 7 is formed by two array antennas of FIG. 1 so the dipole antenna 3', 4', 5', 6' has the same configuration as the first and second dipole antennas 1, 2. The array antenna of FIG. 7 is fabricated on a dielectric substrate. The distance between adjacent two of the dipole antennas 3', 4', 5', 6' is a half of a wavelength and each dipole antenna is fed power by a feeding network 7' and will exhibit the same amplitude and phase excitation. A feeding point 8' is set at a central position of the feeding network 7'. Note that this array antenna may satisfy the directivity and gain required by the WLAN well.

The array antenna may comprise more dipole antennas each of which is fed power by a feeding network.

While the foregoing description includes details that will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An array antenna comprising:

a dielectric substrate having an upper and a lower surfaces;

a first and a second radiating elements and a first connecting portion connecting said first and said second radiating elements arranged on the upper surface of the dielectric substrate;

a first and a second grounding elements and a second connecting portion connecting said first and said second grounding elements arranged on the lower surface of the dielectric substrate;

a feeding point disposed on the first connecting portion and a grounding point disposed on the second connecting portion;

a coaxial cable having an inner conductor coupled to the feeding point and an outer conductor coupled to the grounding point;

wherein the first radiating element and the first wounding element form a first dipole antenna, and the second radiating element and the second grounding element forms a second dipole antenna, said first and said second dipole antennas being fed power by the coaxial cable, and wherein an outline of said substrate defines at least one cutout to comply with a configuration of said first radiating element.

2. The array antenna as claimed in claim 1, wherein a distance between the first dipole antenna and the second dipole antenna is a half to three quarters of a wavelength attained at the operating frequency of the first and second dipole antennas.

3. The array antenna as claimed in claim 1, wherein a distance from the feeding point of the array antenna to the first dipole antenna is equal to that from the feeding point to the second dipole antenna.

4. The array antenna as claimed in claim 1, wherein the array antenna comprises an insulative tab having a hole therein adjacent to the feeding point, said array antenna being fed power via the inner conductor of the coaxial cable through the hole.

5. The array antenna as claimed in claim 1, wherein said first connecting portion comprises a horizontal part, and first and second vertical parts extending perpendicularly from two ends of the horizontal part.

6. The array antenna as claimed in claim 5, wherein the feeding point is disposed on the horizontal part so as to divide the horizontal part into a first section and a second section, and wherein a metal trace from the feeding point to a free distal end of the first radiating element comprises said first section, said first vertical part extending perpendicularly from a distal end of the first section and the first radiating element extending perpendicularly and outside from a distal end of the first vertical part.

7. The array antenna as claimed in claim 5, wherein the feeding point is disposed on the horizontal pan so as to divide the horizontal part into a first section and a second section, and wherein a metal trace from the feeding point to a free distal end of the second radiating element comprises said second section, said second vertical part extending perpendicularly from a distal end of the second section and the second radiating element extending perpendicularly and outside from a distal end of the second vertical part.

8. The array antenna as claimed in claim 1, wherein said first connecting portion is overlapped with and spaced from said second connecting portion with the dielectric substrate being sandwiched therebetween.

9. The array antenna as claimed in claim 1, wherein a metal trace on the upper surface of the dielectric substrate has the same configuration as that on the lower surface of the dielectric substrate.

10. The array antenna as claimed in claim 1, further comprising a third dipole antenna and a fourth dipole antenna which has the same shape as the first and second dipole antenna.

11. The array antenna as claimed in claim 10, wherein said third and said fourth dipole antennas are arranged in a line on the dielectric substrate and the feeding point is positioned at a central position of the four dipole antennas.

12. The array antenna as claimed in claim 1, further comprising an antenna coat covering the array antenna for protecting the array antenna.

13. The array antenna as claimed in claim 1, wherein the array antenna is applied in a device for a wireless local area network.

14. An array antenna comprising:

a dielectric substrate defining a lengthwise direction thereof and a surface thereof;

first and a second radiating elements having a similar shape and spaced from each other on the surface and extending along said lengthwise direction, a first connecting portion connected between said first and said second radiating elements;

a feeding point disposed on the first connecting portion;

a coaxial cable having an inner conductor coupled to the feeding point, wherein an outline of said substrate defines at least one cutout to comply with a configuration of said first radiating element.

15. The antenna as claimed in claim 14, wherein an insulative tab extends from the substrate around said feeding point, through which said coaxial cable extends.

16. An array antenna comprising:

at least three bottom, middle and top levels, said bottom level including a plurality of radiating elements side by side arranged with one another, said radiating elements being arranged with at least two groups having the same number of radiating elements thereof;

said middle level including a plurality of connecting portions side by side arranged with one another to respectively connect the corresponding radiating elements in the same group;

said top level including a feeding network line electrically connected to the connecting portions; and a substrate, of which said radiating elements and said connecting portions are arranged on one surface; wherein a feeder cable is mechanically and electrically connected to said feeding network line and wherein said substrate has an insulative tab formed around the top level to hold said feeder cable in position.

17. The antenna as claimed in claim 16, wherein the feeding network line defines a plurality of protrusions directly connecting to the connecting portions.

18. The antenna as claimed in claim 16, wherein there are only two groups.

19. The antenna as claimed in claim 16, further comprising a plurality of grounding elements side by side arranged with one another on the other surface opposite to said surface at the bottom level, said grounding elements linked to a plurality of connecting sections side by side ranged with one another at the middle level; wherein said connecting sections are overlapped with the connecting portions in a thickness direction of said substrate while the grounding elements are oriented in a direction opposite to that the radiating elements are oriented along.

20. The antenna as claimed in claim 19, wherein the connecting sections and the connecting portions are of a U-shaped configuration oriented in a first direction, and said radiating elements and said grounding elements are oriented in a second direction perpendicular to said first direction.

* * * * *